US009815584B2

(12) United States Patent
Schwester

(10) Patent No.: US 9,815,584 B2
(45) **Date of Patent: *Nov. 14, 2017**

(54) PRODUCT PACKAGE AND RELATED METHOD

(71) Applicant: Charles Schwester, Kinnelon, NJ (US)

(72) Inventor: Charles Schwester, Kinnelon, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/606,090

(22) Filed: May 26, 2017

(65) Prior Publication Data

US 2017/0259954 A1 Sep. 14, 2017

Related U.S. Application Data

(63) Continuation-in-part of application No. 14/876,985, filed on Oct. 7, 2015, now Pat. No. 9,663,266, which is a continuation-in-part of application No. 14/598,438, filed on Jan. 16, 2015, now abandoned.

(60) Provisional application No. 61/928,578, filed on Jan. 17, 2014.

(51) Int. Cl.

| | |
|---|---|
| ***B65D 5/38*** | (2006.01) |
| ***B65B 5/04*** | (2006.01) |
| ***B65D 43/16*** | (2006.01) |
| ***B65D 77/04*** | (2006.01) |
| ***B65D 85/20*** | (2006.01) |
| ***A24F 9/16*** | (2006.01) |
| ***A24F 47/00*** | (2006.01) |

(52) U.S. Cl.

CPC ..... *B65D 5/38* (2013.01); *A24F 9/16* (2013.01); *A24F 47/002* (2013.01); *B65B 5/04* (2013.01); *B65D 43/161* (2013.01); *B65D 77/04* (2013.01); *B65D 85/20* (2013.01)

(58) Field of Classification Search

CPC ..... B65D 5/38; B65D 5/503; B65D 11/12; B65D 3/20; B65D 5/728; B65B 5/04

USPC ..... 229/5.5, 125.125, 102; 206/557; 220/345.3; 221/246

See application file for complete search history.

(56) References Cited

U.S. PATENT DOCUMENTS

| | | | | |
|---|---|---|---|---|
| 2,605,892 | A | 8/1952 | Waber | |
| 2,613,806 | A * | 10/1952 | Testi | B65D 83/10 221/229 |
| 3,648,918 | A | 3/1972 | Van Inwagen | |
| 3,888,350 | A | 6/1975 | Horvath | |
| 4,284,204 | A | 8/1981 | Carey, Jr. | |
| 4,364,488 | A | 12/1982 | Anjou | |
| 6,230,893 | B1 | 5/2001 | Karow | |
| 6,412,636 | B1 | 7/2002 | Jones et al. | |
| 6,460,693 | B1 * | 10/2002 | Harrold | B65D 83/0463 206/1.5 |
| 6,491,211 | B1 | 12/2002 | Evans et al. | |

(Continued)

FOREIGN PATENT DOCUMENTS

CA 2386594 A1 4/2001

*Primary Examiner* — Christopher Demeree
(74) *Attorney, Agent, or Firm* — Thomas L. Adams

(57) ABSTRACT

A package has a tray slidably mounted in a carton. The carton has a front access port and at least one catch. The tray has a pair of stops positioned to successively engage at least one catch in order to restrict outward movement of the tray. The tray can be positioned with the pair of stops located inwardly of, and locked in place by, at least one catch. The catch on the carton can be manipulated to clear one of the pair of stops and allow it to move outwardly past the catch.

16 Claims, 21 Drawing Sheets

(56) References Cited

U.S. PATENT DOCUMENTS

| | | | | |
|---|---|---|---|---|
| 6,676,013 | B2 * | 1/2004 | Auclair | B65D 5/38 229/122 |
| 7,708,142 | B2 | 5/2010 | Ehrlund | |
| 7,757,843 | B2 | 7/2010 | Katsis | |
| 7,810,640 | B2 | 10/2010 | Weston | |
| 7,845,496 | B2 | 12/2010 | Hession | |
| 8,087,540 | B2 | 1/2012 | Bailey et al. | |
| 2004/0050748 | A1 | 3/2004 | Ehrlund | |
| 2004/0188311 | A1 | 9/2004 | Paliotta et al. | |

* cited by examiner

FIG. 25
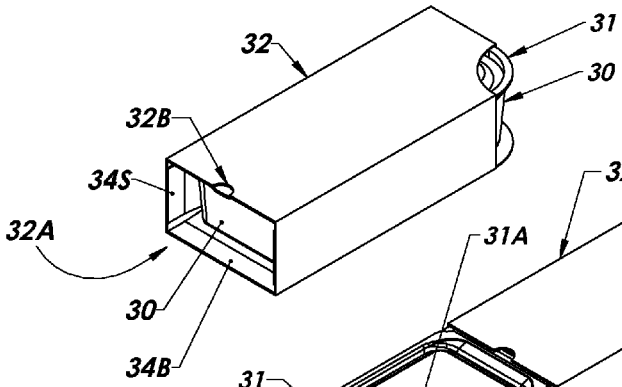
FIG. 26
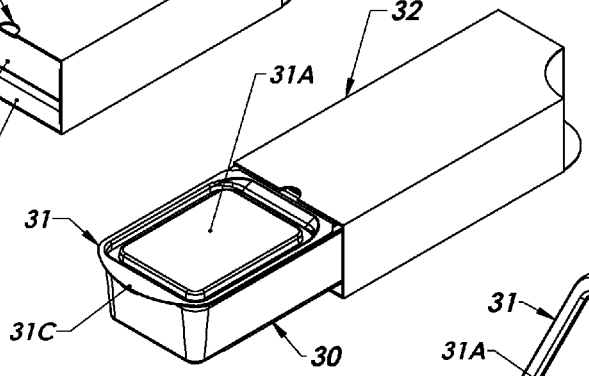
FIG. 27
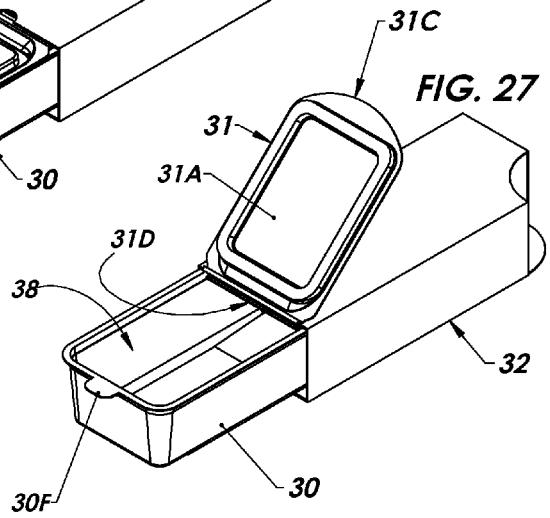
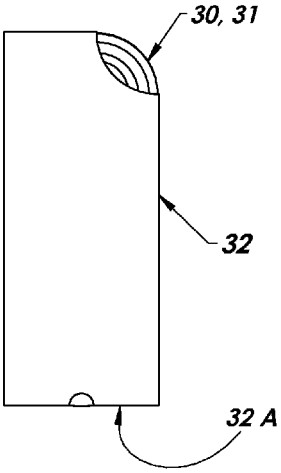
FIG. 22
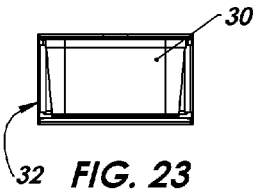
FIG. 23
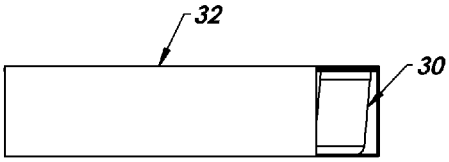
FIG. 24

PRODUCT PACKAGE AND RELATED METHOD

CROSS-REFERENCES TO RELATED APPLICATIONS

This application is a continuation in part of U.S. patent application Ser. No. 14/876,985 filed Oct. 7, 2015, which in turn claims the benefit of U.S. patent application Ser. No. 14/598,438 filed Jan. 16, 2015, which in turns claims the benefit of U.S. Provisional Patent Application, Ser. No. 61/928,578, filed Jan. 17, 2014, the contents of said three applications being hereby incorporated by reference herein.

BACKGROUND OF THE INVENTION

1. Field of the Invention

The present invention relates to a paper board folding carton with a plastic tray insert, which is provided as a multi-use system to deliver a product to the consumer and be reused once opened. Alternatively the arrangement may be operated multiple times before it has a structural failure 2. Description of Related Art Existing prior art solutions typically entail rigid plastics at high volumes and costly tooling, more robust outer cartons at higher costs with less esthetics regarding the finished unit, and such designs also have a higher degree of environmental impact to manufacture and dispose of during its life cycle.

Packages containing certain products ought to be designed to be resistant to opening by a child. A package that requires separate manipulation by both hands is considered difficult for a child to open.

See also U.S. Pat. Nos. 3,888,350; 4,364,488; 6,230,893; 6,412,636; 6,491,211; 7,708,142; 7,757,843; 7,810,640; 7,845,496; and 8,087,540, as well as U.S. Patent Application Publication Nos. 2004/0050748; and 2004/0188311.

SUMMARY OF THE INVENTION

In accordance with the illustrative embodiments demonstrating features and advantages of the present invention, there is provided a package including a carton having a front access port and at least one catch. The package also includes a tray slidably mounted in the carton. The tray has a pair of riders positioned to successively engage the at least one catch in order to restrict outward movement of the tray.

In accordance with another aspect of the invention, a packaging method is provided employing a tray slidably mounted in a carton. The carton has an access port bordered by one or more flaps. The tray has a pair of stops. The method includes the step of positioning the tray with the pair of stops located inwardly of, and locked in place by, the one or more flaps. Another step is depressing at least one of the one or more flaps to clear one of the pair of stops and allow it to move outwardly past the one or more flaps.

The present arrangement provides a product package that integrates a first thermoformed tray, with an optional thermoform lid, with a second component, namely a paper board carton that transforms the package from a single use container to a multi-use system that can be opened and closed over a hundred times.

One exemplary feature of the present design is the integration between the plastic articles and paper board carton. Using four flaps on one end of a standard folding carton, they are folded into the cardboard carton to generate recoil energy in the paper board to spring out engaging the inner thermoformed part, in conjunction with a number of recessed surfaces or bosses on the plastic articles. The package can be kept closed until the consumer initiates the opening the unit.

Such an arrangement also maintains a similar relationship when opened, with additional surfaces keeping the plastic articles from being separated from the outer paper board carton, keeping the unit intact.

Once the unit is opened, a user now has access to the product or products by removing the product from the thermoformed package or from opening the hinged lid of the inner plastic article. After use of the product the user returns the products to the container, closes the unit, and stores in the "Stiletto Pak" until they need to use again. This design uses a two piece inner plastic articles but can also be done with a single inner tray.

In one embodiment, the disclosed package has a tray that is slidably mounted in a carton. Four flaps border a front opening in the carton (an upper flap, lower flap, and two side flaps). The tray has a receptacle for receiving a product such as an e-cigarette. The forward end of the tray has a flange-like, lower finger tab. The back end of the tray is enlarged to form stops, disclosed as aft abutments. The tray may be vacuum formed, blow molded, or injection molded and has a well that forms a front stop.

With product loaded into the tray, the flaps are folded inwardly before sliding the tray into the carton. Eventually, a front stop on the tray will move inwardly past the lower flap, which flap will then lift and lock onto the front stop, thereby keeping the tray in a fully retracted position.

To release the tray, a user will squeeze and slightly rotate the tray's front tab down against the lower flap, thereby allowing the front stop to clear the flap The user will then use the tray's tab to slide the tray outwardly into the dispensing position.

Outward movement of the tray will be halted when rear stops on the tray engage the side and upper flaps on the front opening of the carton. The product can then be removed from the tray, used, and then returned to the tray.

The tray can then be pushed back inside the carton until the tray's front stop passes the carton's lower flap to lock the tray in place again In another embodiment, the disclosed package has another type of tray slidably mounted inside a carton. Four flaps border an opening in the carton. A lid that fits onto the tray has a forward hinged section that can swing up to allow access to the product in the tray. The forward end of the lid has a finger tab The back end of the tray has a pair of ridges acting as stops (also referred to as aft abutments).

The tray may be vacuum formed, blow molded, or injection molded with a floor having a forward plateau adjacent a well that forms a front stop (also referred to as a forward abutment).

With product loaded into the tray, the carton's flaps are folded inwardly before sliding the tray into the carton. Eventually, the tray's front stop will move inwardly past the carton's lower flap, which flap will then lift and lock the front stop in a fully retracted position. The tray is configured to allow a user to reach the lower flap, even in the tray's fully retracted position.

To release the tray, a user will depress the carton's lower flap, thereby allowing the tray's front stop to clear the lower flap. The user will then grasp the tray's tab and pull the tray into the dispensing position. Because two separate hand movements are required for this maneuver, this packaging is considered child resistant.

Outward movement of the tray is halted when rear stops on the tray engage the carton's side flaps. The product can then be removed from tray by lifting the front section of the lid.

Afterward the lid can be closed, and tray can then be pushed back inside the carton until the tray's front stop passes over the carton's lower flap to lock the tray in place again.

Other embodiments with specific features are disclosed as well

BRIEF DESCRIPTION OF THE DRAWINGS

The above brief description as well as other objects, features and advantages of the present invention, including the package's shape, design and operation, will be more fully appreciated by reference to the following detailed description of illustrative embodiments in accordance with the present invention when taken in conjunction with the accompanying drawings, wherein:

FIG. 22 is a top view of the tray of FIG. 10 installed in a carton to form a package that is an alternate to that of FIG. 1;

FIG. 23 is a front end view of the package of FIG. 22;

FIG. 24 is a side view of the package of FIG. 22;

FIG. 25 is a perspective view of the package of FIG. 22;

FIG. 26 is a perspective view of the package of FIG. 22 with its tray partially deployed;

FIG. 27 is a perspective view of the package of FIG. 26 with the front section of the lid of the tray swung upwardly;

DETAILED DESCRIPTION

Figure 1:
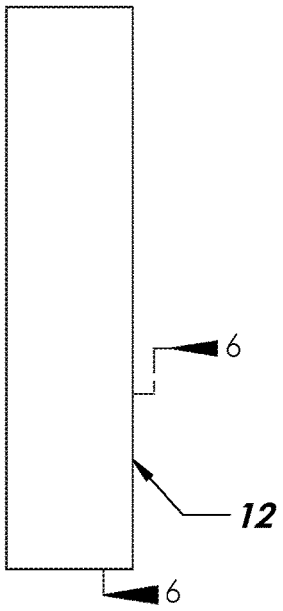
FIG. 1 is a top view of a package in accordance with principles of the present invention.
Figure 2:
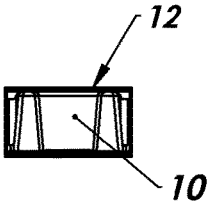
FIG. 2 is an end view of the package of FIG. 1.
Figure 3:
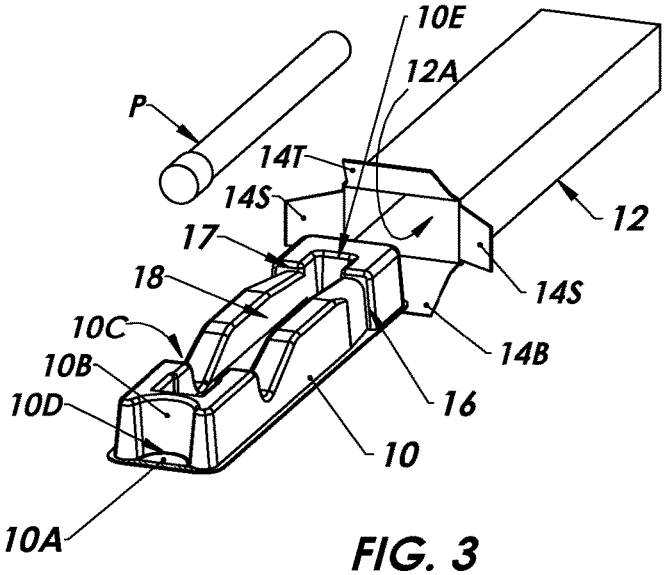
FIG. 3 is a perspective view of the package of FIG. 1 showing the product above the tray and the tray removed from the carton.
Figure 4:
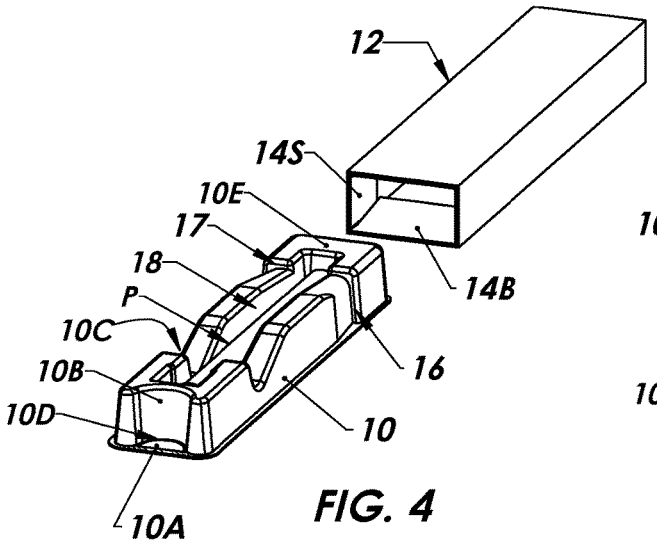
FIG. 4 is a perspective view of the package of FIG. 3 with the product inserted into the tray and the carton flaps folded inwardly.

Referring to FIGS. 1-6, the illustrated package is composed of a carton 12 and sliding tray 10. In FIG. 3, carton 12 is shown as a rectangular box with a front opening 12A bordered by four flaps: two side flaps 14S, a top flap 14T, and bottom flap 14B. Opening 12A is also referred to as a front access port. Each of the flaps 14S, 14T, and 14B are disposed 90° from the adjacent flap. In this embodiment flap 14T may be folded inwardly, or may be simply folded down to initially close carton 12 before purchase. Flaps 14S and 14B will be folded inwardly to function as catches in a manner to be described presently.

Tray 10 may be a thermoformed article (e.g., vacuum formed, or blow or injection molded). Tray 10 is designed to hold product P in longitudinal socket 18, between its end walls (e.g., end wall 10E) and sidewalls These side walls have a pair of notches 10C for grasping the product P during loading and removal. Product P is shown as an elongated cylindrical article, such as electronic cigarette, although other types of products may be employed as well.

Tray 10 has a vertically disposed pair of aft shoulders 16 (only one visible in FIG. 3) on the right and left, and along the top a horizontally disposed shoulder 17, which is split in two by socket 18. Shoulders 16 and 17 are abutments that are also referred to as stops or riders.

Figure 6:
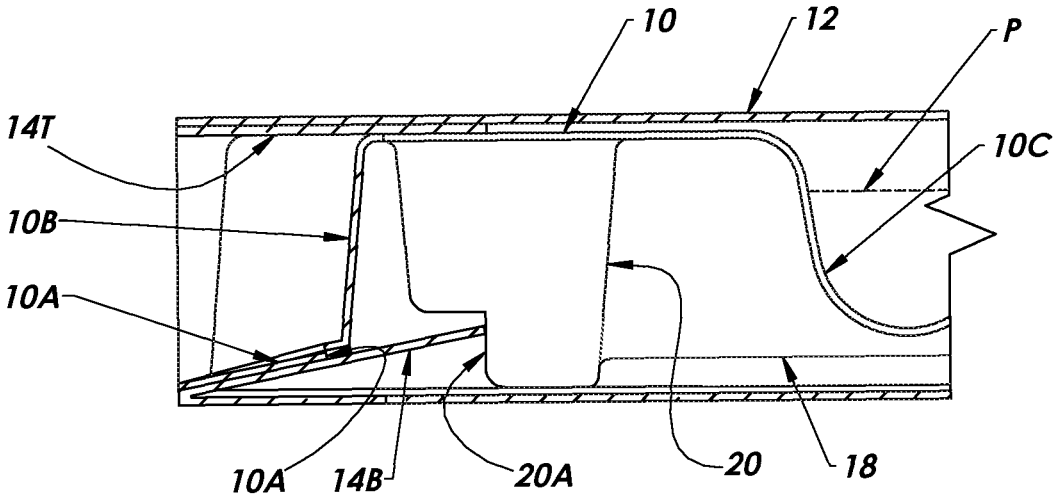
FIG. 6 is a sectional view taken along lines 6-6 of FIG. 1.

In FIG. 6, the portion of longitudinal socket 18 in front of notch 10C has a gutter shape that leads to a well-like feature 20 (product P shown in phantom).

From underneath, feature 20 appears as a slab with a distal step that forms a forward abutment 20A (this abutment at the front of the tray is also referred to as a rider in the form of a ridge or shoulder acting as a stop). It will be noticed that abutment 20A is longitudinally spaced from previously mentioned abutments 16 and 17.

The front of tray 10 has a ledge 10A (FIGS. 1, 4, and 6) that is split from concave wall 10B at slit 10D to form a forward cantilevered tab. In FIG. 6 cantilevered tab 10A is shown resting against previously mentioned flap 14B, whose distal end engages abutment 20A and prevents outward movement of tray 10.

Figure 5:
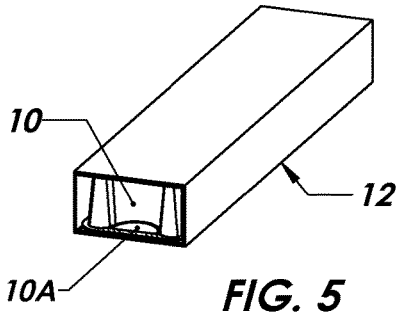
FIG. 5 is a perspective view of the package of FIG. 1.
Figure 7:
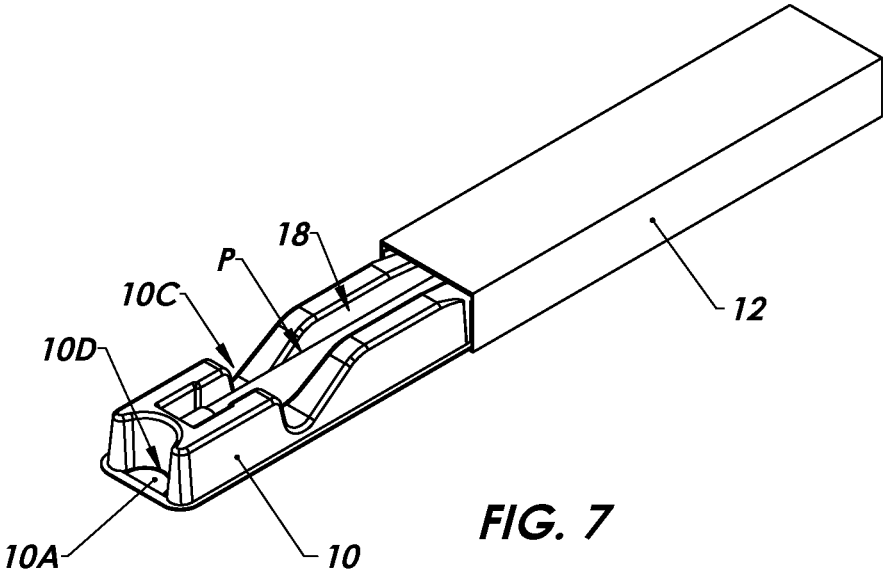
FIG. 7 is a perspective view of the package of FIG. 1 with its tray partially deployed.

In FIGS. 1, 2, and 5 tray 10 is shown completely lodged inside carton 12, this condition being referred to as the retracted position of the tray. If cantilever tab 10A is manually depressed, flap 14B will be pushed below abutment 20A to allow outward movement of tray 10. In FIG. 7, tray 10 has moved outwardly from carton 12 allowing a user to grasp product P through notch 10C.

Figure 8:
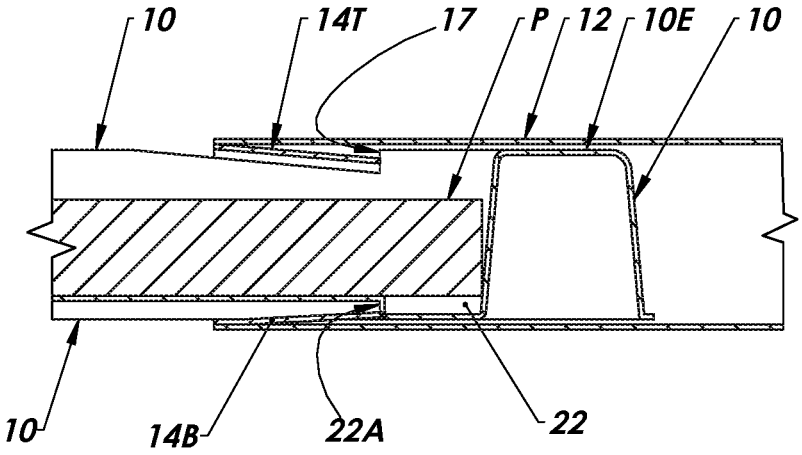
FIG. 8 is a vertical sectional view of the package of FIG. 7 showing in detail the aft end of the tray.

Referring to FIG. 8, tray 10 has a hollow rear wall 10E behind a well-like feature 22 forming a forward abutment 22A. (This abutment is also referred to as rider in the form of a ridge or shoulder that acts as a stop). In this Figure, tray 10 has been pulled outwardly (as shown in FIG. 7) causing flaps 14T and 14B to engage aft abutments 17 and 22A, respectively, which engagement prevents further outward movement of the tray. It will be noticed that flap 14B has a dual purpose. Specifically, flap 14B can engage abutment 22A to prevent removal of the tray 10, and also is able to engage abutment 20A (FIG. 6) to keep the tray in the retracted position.

Figure 9:
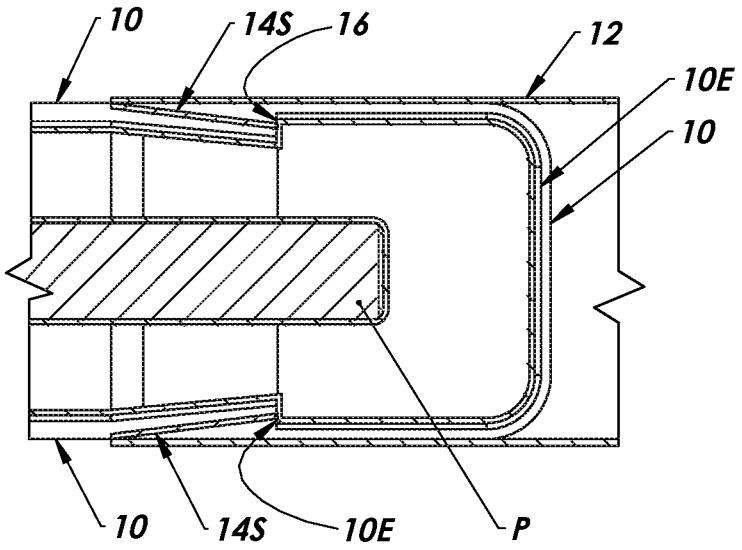
FIG. 9 is a horizontal sectional view of the portion of the package shown in FIG. 8.
Figure 10:
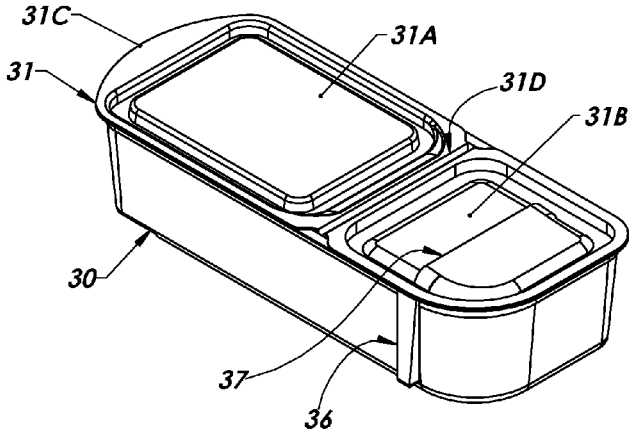
FIG. 10 is a perspective view of a tray that is an alternate to that of FIG. 3.
Figure 11:
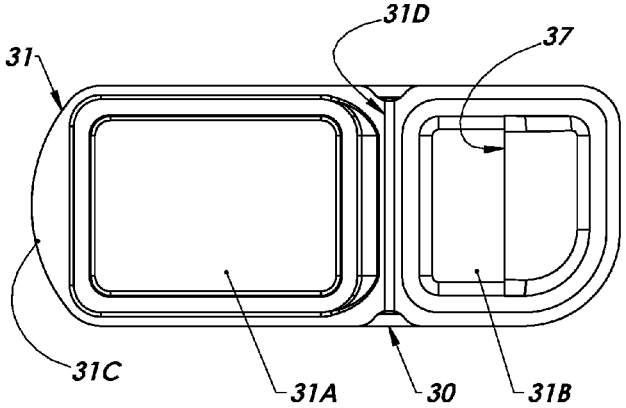
FIG. 11 is a top view of the tray of FIG. 10.
Figure 12:
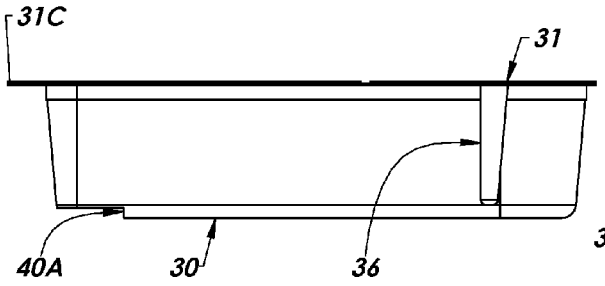
FIG. 12 as a side view of the tray of FIG. 10.
Figure 13:
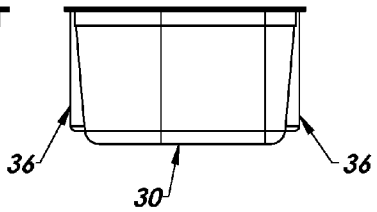
FIG. 13 is a front end view of the tray of FIG. 10.

Referring to FIG. 9, tray 10 has been pulled outwardly as just described, causing flaps 14S to engage previously mentioned abutments 16, which engagement also prevents further outward movement of tray 10.

In ordinary use, product P is delivered to a user inside tray 10 with the tray placed inside carton 12 as shown in FIG. 5. The package of FIG. 5 may be wrapped to close the open end of the carton 12. Alternatively, top flap 14T may be manufactured with a length and width that allows the flap to be folded down and around the opening to close the package.

When the package is opened as shown in FIG. 5, the user may reach in and depress tab 10A to depress flap 14B (FIG. 6). Flap 14B will descend to a position below tray 10 allowing the passage of feature 20 and abutment 20A. At the same time, the user can use tab 10A to pull tray 10 outwardly to the position shown in FIG. 7. Tray 10 cannot be removed from carton 12 because flaps 14B and 14T (FIG. 8) engage the forward faces of abutments 17 and 22A, respectively, thereby limiting outward travel to a predetermined amount. Likewise, flaps 14S (FIG. 9) engage the forward faces of abutments 16, also preventing further outward movement.

With tray 10 fully deployed, the user may now grasp product P through notches 10C, and use the product for its intended purpose. If product P has not been expended, it may be returned to socket 18. The user may now push tray 10 back to the retracted position. Eventually, feature 20 will pass over flap 14B, so that the flap can spring back into engagement with the forward face of abutment 20A, as shown in FIG. 6. Under those circumstances, tray 10 will not inadvertently slide out of carton 12 but will remain stored and protected in the retracted position.

Figure 18:
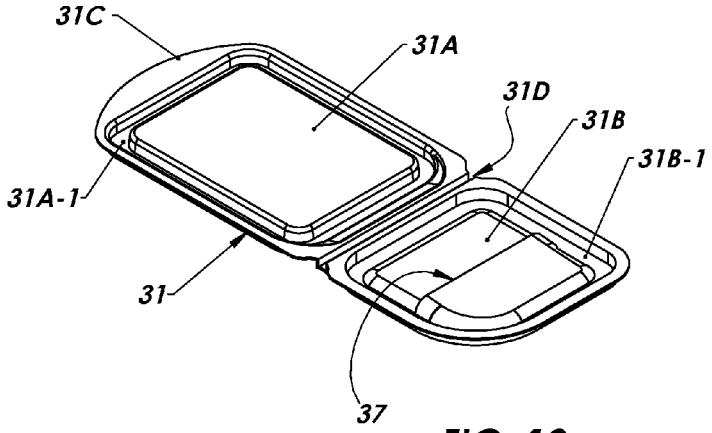
FIG. 18 is a perspective view of the lid of the tray of FIG. 10.
Figure 19:
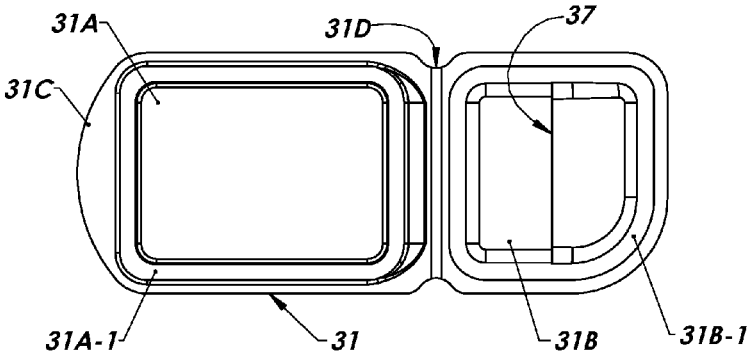
FIG. 19 is a top view of the lid of FIG. 18.
Figure 20:
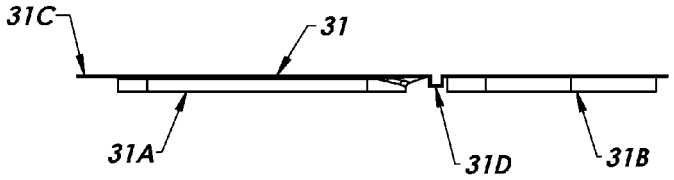
FIG. 20 is an edge view of the lid of FIG. 18.
Figure 21:
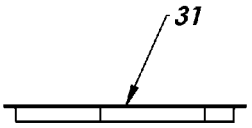
FIG. 21 is a front end view of the lid of FIG. 18.

Referring to FIGS. 10-32B, components corresponding to those previously illustrated in FIGS. 1-9, have the same reference numbers but increased by 20. Tray 30 is a container that can receive on its rim a lid 31, and both may be thermoformed articles (e.g., vacuum formed, or blow or injection molded). The front of tray 30 has a finger tab 30F (FIGS. 14-16) and lid 31 has a finger tab 31C (FIGS. 18-20).

Referring to FIGS. 18-21, adjacent sections 31A and 31B of lid 31 are joined by a transverse wrinkle 31D that acts as a hinge. Front section 31A is substantially flat except for a gutter 31A-1. Gutter 31B-1 surrounds a central region of rear section 31B, which contains a horizontally disposed shoulder 37 (the shoulder is sometimes referred to as an abutment or a rider acting as a stop).

Referring to FIGS. 22-25, the illustrated package is composed of a carton 32 and sliding tray 30. Tray 30 is shown completely lodged inside carton 32, this condition being referred to as the retracted position of the tray. The rear right corner of carton 32 has for practical and aesthetic reasons a rear opening that exposes the rear right corner of tray 30 and lid 31.

In FIGS. 25, 31A, 31B, 32A, and 32B, carton 32 is shown as a rectangular box with a front opening 32A (access port) bordered by four inwardly folded flaps: two side flaps 34S, a top flap 34T, and bottom flap 34B. Each of the flaps 34S, 34T, and 34B are disposed 90° from the adjacent flap. These flaps are also referred to as catches.

Figure 14:
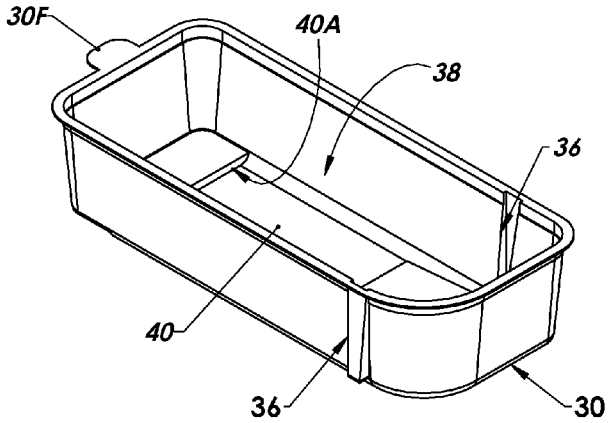
FIG. 14 is a perspective view of the tray of FIG. 10 with its lid removed.
Figure 15:
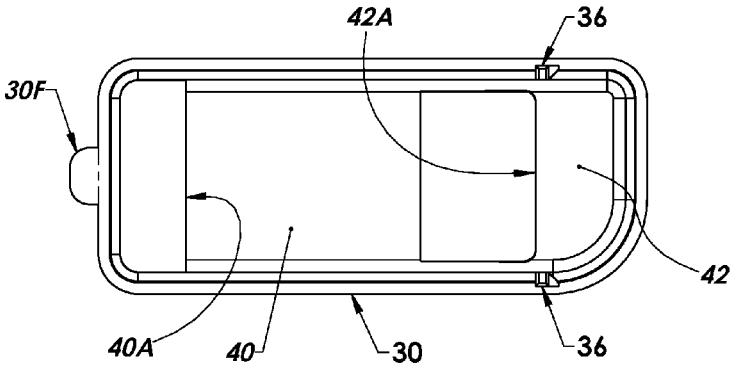
FIG. 15 is a bottom view of the tray of FIG. 14.
Figure 16:
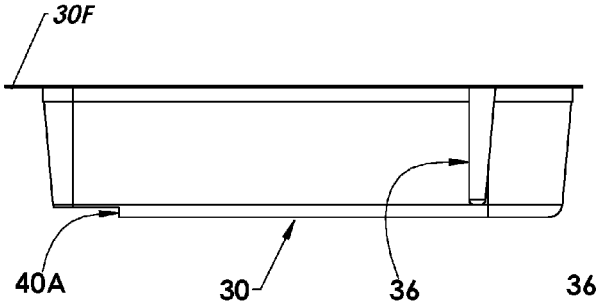
FIG. 16 is a side elevational view of the tray of FIG. 14.
Figure 17:
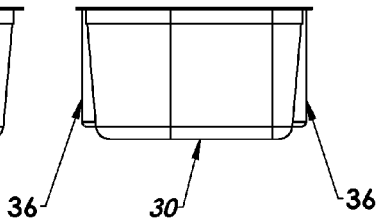
FIG. 17 is a front end view of the tray of FIG. 14.

Referring to FIGS. 14-16, tray 30 is designed to hold a loose product (e.g. tobacco) in interior 38. Tray 30 has a vertically disposed pair of aft ridges 36 on the right and left. Ridges 36 are stops that are also referred to as riders or abutments.

A well-like feature 40 in tray 30 has a distal step that forms a forward abutment 40A (this abutment at the front of the tray is also referred to as a rider in the form of a shoulder acting as a stop). It will be noticed that abutment 40A is longitudinally spaced from previously mentioned abutments 36 and 37.

Figure 29B:
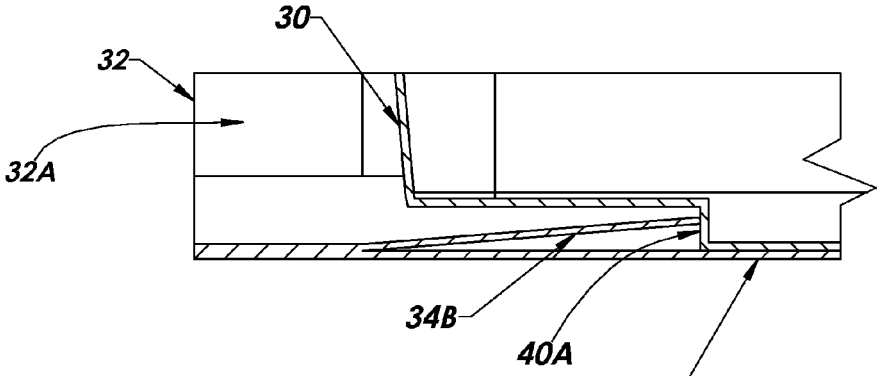
FIG. 29B is a detailed view of the bottom front portion of the package of FIG. 29A.
Figure 28:
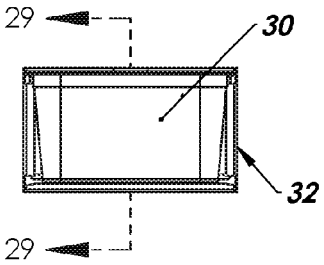
FIG. 28 is a front end view of the package of FIG. 22.
Figure 29A:
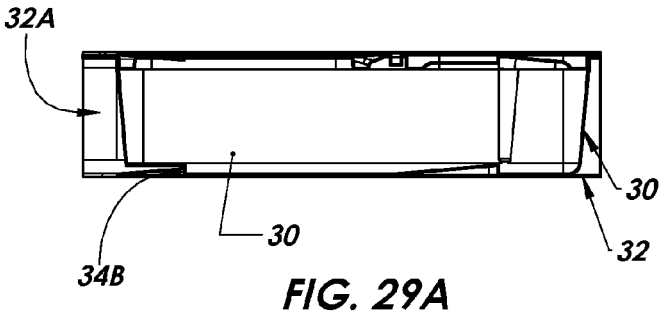
FIG. 29A is a sectional view taken along line 29-29 of FIG. 28.

In FIGS. 29A and 29B the distal end of flap 34B is shown engaging abutment 40A to prevent outward movement of tray 30 from the retracted position. In this position the lower front corner of tray 30 does not extend through the opening 32A, leaving much of flap 34B accessible. Accordingly, a user can manually depress flap 34B so it descends below abutment 40A to allow tray 30 to move outwardly from the retracted position. This can be accomplished by pressing the exposed right rear corner of tray 30 and lid 31 (FIG. 25) and/or by grasping finger tabs 31C and 30F through notch 32B formed in carton 32. Since two separate hands are required for this maneuver, the package is considered child resistant.

Figure 31A:
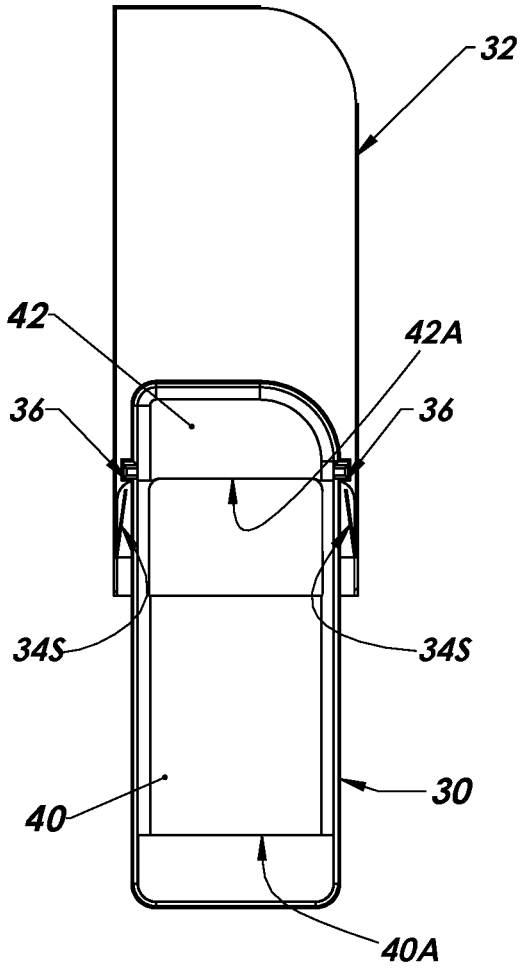
FIG. 31A is a sectional view of the package of FIG. 26 taken along line 31-31 of FIG. 30.
Figure 30:
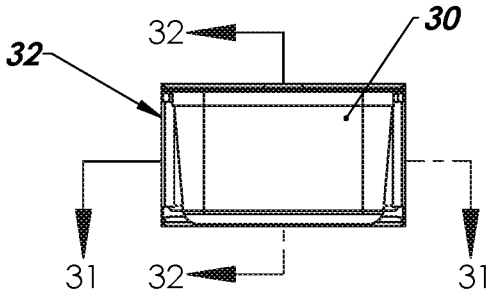
FIG. 30 is a front end view of the package of FIG. 26.
Figure 31B:
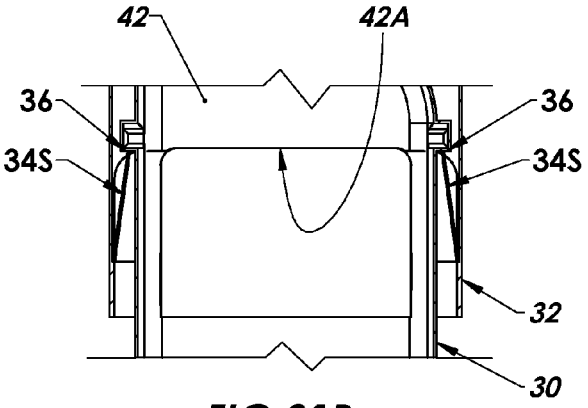
FIG. 31B is a detailed view of the package of 31A at the front of the carton.

In FIG. 26, tray 30 has moved outwardly from carton 32 to a fully extended position, exposing lid section 31A. FIGS. 31A and 31B also show this fully extended position, wherein flaps 34S have swung inwardly to engage previously mentioned abutments 36, which engagement prevents further outward movement of tray 30.

Figure 32B:
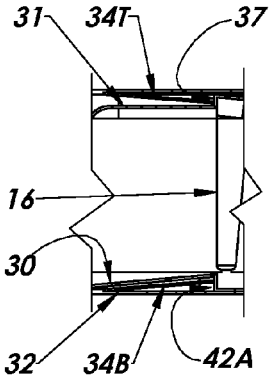
FIG. 32B is a detailed view of the package of FIG. 32A showing a catch preventing tray removal.
Figure 32A:
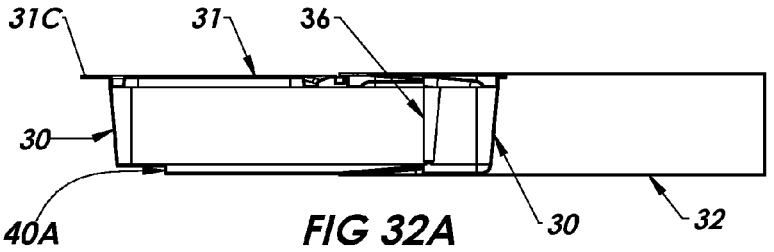
FIG. 32A is a sectional view of the package of FIG. 26 taken along line 32-32 of FIG. 30.

Also, in the fully extended position illustrated in FIGS. 32A and 32B, flaps 34T and 34B engage abutments 37 and 42A, respectively, which engagement also prevents further outward movement of the tray. It will be noticed that flap 34B has a dual purpose. Specifically, flap 34B can engage abutment 42A to prevent removal of the tray 30, and also is able to engage abutment 40A (FIG. 29B) to keep the tray in the retracted position.

In FIG. 27 a user has grasped finger tabs 30F and 31C to lift section 31A, which articulates around hinge joint 31D. At this time a user will be able to obtain the product (not shown) placed inside the interior 38.

In ordinary use, product is delivered to a user inside tray 30 with lid section 31A releasably closed on the tray, with section 31B glued or snapped onto the tray, and with the tray placed inside carton 32 as shown in FIG. 25. The package of FIG. 25 may be wrapped to close the open end 32A of carton 32.

When the package is unwrapped as shown in FIG. 25, the user may reach in and depress flap 34B. Flap 34B (FIG. 29B) will descend to a position below tray 30 allowing the passage of feature 40 and abutment 40A. At the same time, the user can use tab 30F and 31C to pull tray 30 and lid 31 outwardly to the position shown in FIG. 26 The user may also press tray 30 outwardly by pushing the exposed rear right corner of tray 30. Again the dual hand maneuvers make the package child resistant.

Tray 30 cannot be removed from carton 32 because flaps 34B and 34T (FIG. 32B) will engage the forward faces of abutments 37 and 42A, respectively, thereby limiting outward travel to a predetermined amount. Likewise, flaps 34S (FIG. 31B) engage the forward faces of abutments 36, also preventing further outward movement.

With tray 30 fully deployed, the user may now use tabs 30F and 31C to lift section 31A (FIG. 27), obtain any desired amount of product in interior 38, and use the product for its intended purpose.

If the product has not been expended, the user may now close section 31A, and push tray 30 back to the retracted position. Eventually, feature 40 will pass over flap 34B, so that the flap can spring back into engagement with the forward face of abutment 40A, as shown in FIG. 29B. Under those circumstances, tray 30 will not inadvertently slide out of carton 32 but will remain stored and protected in the retracted position.

Figure 33:
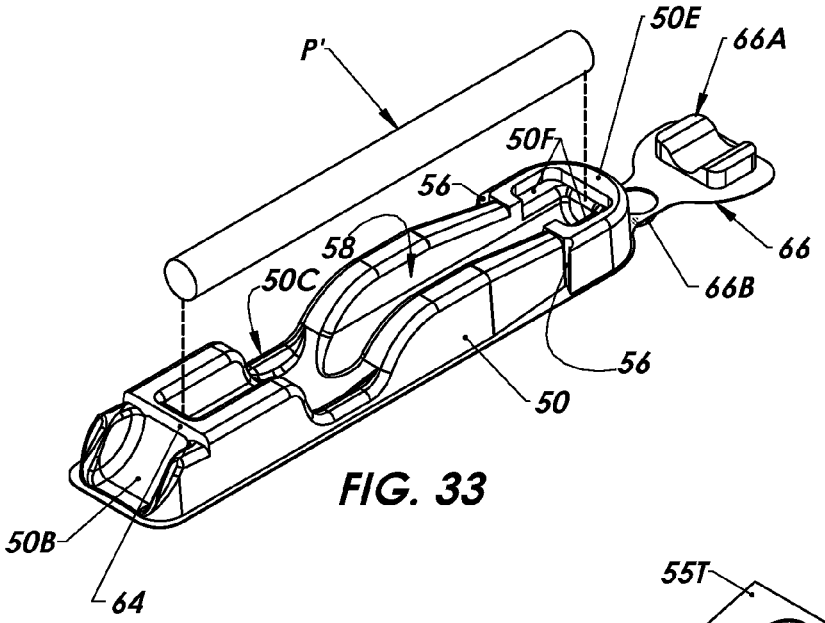
FIG. 33 is a perspective view of a tray that is an alternate to those previously illustrated.
Figure 34:
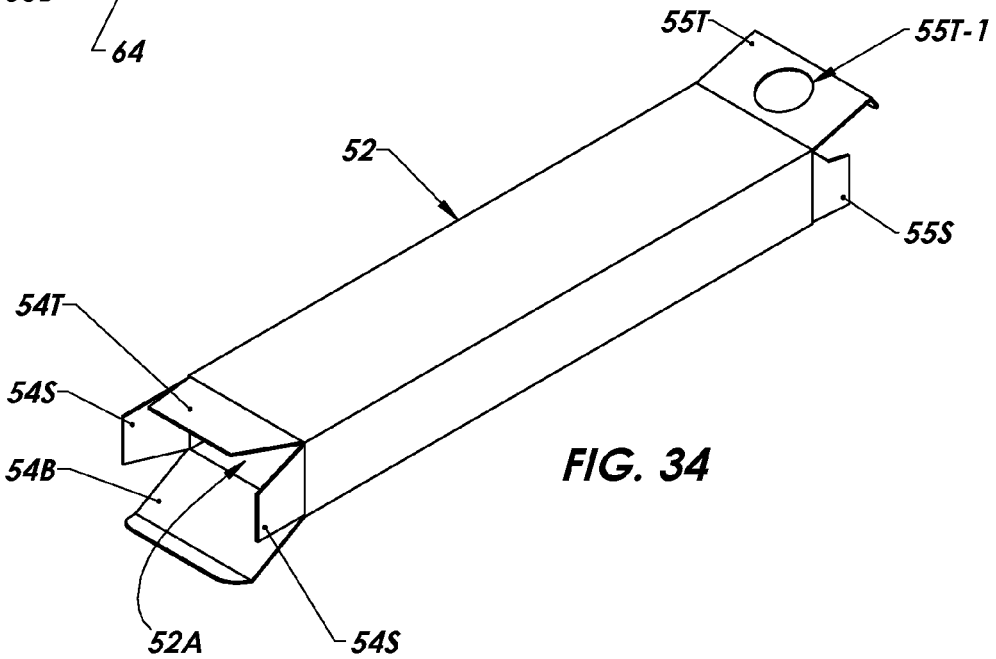
FIG. 34 is a perspective view of a carton for holding the tray of FIG. 33 in order to form a package.

Referring to FIGS. 33-37, components corresponding to those previously illustrated in FIGS. 1-9, have the same reference numbers but increased by 40. The illustrated package is composed of a carton 52 and sliding tray 50. In FIG. 34, carton 52 is shown as a rectangular box with a front opening 52A bordered by four flaps: two side flaps 54S, a top flap 54T, and bottom flap 54B. Opening 52A is also referred to as a front access port. Each of the flaps 54S, 54T, and 54B are disposed 90° from the adjacent flap.

In this embodiment flaps 54T and 54S will be folded inwardly to function as catches in a manner to be described presently. Flap 54B will be folded upwardly to initially close carton 52, but will be torn off after purchase. The back of carton 52 is closed by means of a pair of side flaps 55S (only one visible in FIG. 34) and a top flap 55T, which has a circular rear opening 55T-1

Tray 50 may be a thermoformed article (e.g., vacuum formed, or blow or injection molded). Tray 50 is designed to hold product P' in longitudinal socket 58, between its end walls (e.g., end wall 50E) and sidewalls. These side walls have a pair of notches 50C for grasping the product P' during loading and removal Product P' is shown as an elongated cylindrical article, such as electronic cigarette, although other types of products may be employed as well.

Tray 50 has a vertically disposed pair of aft shoulders 56 on the right and left Tray 50 also has a horizontally disposed, front shoulder 64 rising above a concave alcove 50B. Shoulder 64 is an abutment that is also referred to as a stop or rider. It will be noticed that shoulder 64 is longitudinally spaced from shoulders 56.

Integral tether 66 extends from a lower rear corner of tray 50 and has on its distal end a holder 66A in the form of a longitudinally disposed cradle. Holder 66A is designed to be pressed down into the aft end of tray 50 and rest on a pair of shelves 50F on opposite sides of socket 58. Tether 66 has between holder 66A and tray 50 a bubble-like protrusion 66B, serving a purpose to be described presently.

Figure 35:
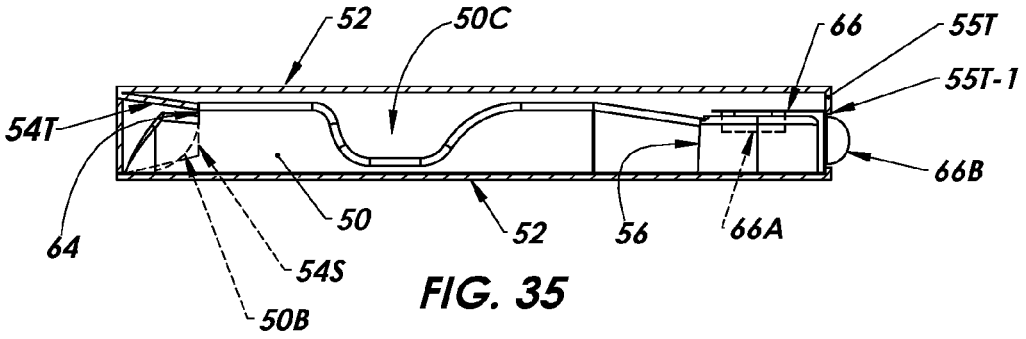
FIG. 35 is a vertical sectional view showing the tray of FIG. 33 installed in the carton of FIG. 34.

In FIG. 35, tray 50 is shown completely lodged inside carton 52, this condition being referred to as the retracted position of the tray. Holder 66A has been snapped into tray 50 to rest on shelves 50F (FIG. 33). Under these circumstances, protrusion 66B extends rearwardly through opening 55T-1.

Figure 36:
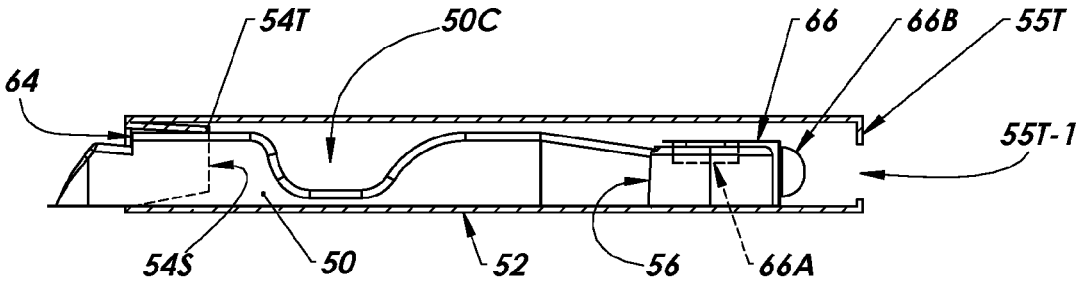
FIG. 36 is a vertical sectional view showing the tray of FIG. 35 released from a front catch.

A user will have access to upper flap 54T through alcove 50. If flap 54B is pushed above shoulder 64, tray 50 will be able to move outwardly. This outward movement can be facilitated by pushing on protrusion 66F, and then grasping tray 50 between alcove 50B and the underside of the tray to continue pulling the tray out. This maneuver is considered child resistant. In FIG. 36, tray 50 has been moved outwardly from carton 52, traveling under flap 54T.

Figure 37:
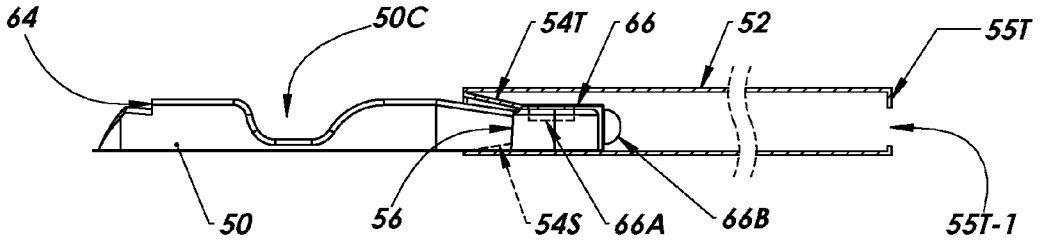
FIG. 37 is a vertical sectional view showing the tray of FIG. 35 restrained from removal by a front catch.
Figure 38:
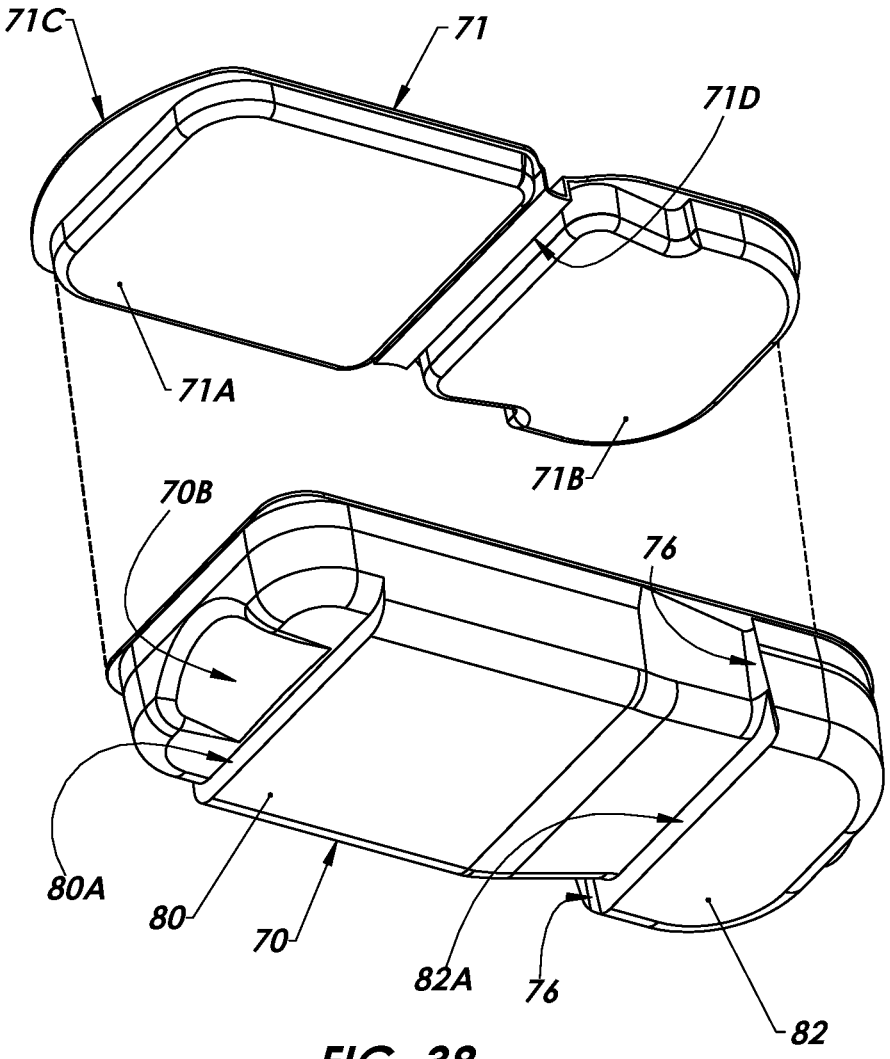
FIG. 38 is a perspective view of a tray that is an alternate to those previously illustrated, shown with its lid removed from the lower container.

In FIG. 37 tray 50 has moved outwardly to the extent that side flaps 54S have engaged shoulders 56, which engagement prevents further outward movement. Neither of the side flaps 54S are directly visible in this view, but left side flap 54S is shown in phantom and extending to reach shoulder 56 on the left side of tray 50. Accordingly, flaps 54S will engage both shoulders 56 and will therefore also prevent further outward movement of tray 50.

Flap 54T is shown engaging the distal edge of tether 66 to also prevent further outward movement of tray 50. Accordingly, tether 66 is acting as an abutment or stop (or rider). It will be noticed that flap 54T has a dual purpose. Specifically, flap 54B can engage tether 66 to prevent removal of the tray 50, and also is able to engage shoulder 64 (FIG. 35) to keep the tray in the retracted position.

In ordinary use, product P' is delivered to a user inside tray 50 with tether 66 folded as shown in FIG. 35 to place holder 66A around the product and resting on shelves 50F (FIG. 33). Holder 66A can either loosely fit inside tray 50, can snap inside the tray, or can be glued into position.

Tray 50 is placed inside carton 52 as shown in FIG. 35 with protrusion 66B extending through opening 55T-1. The package of FIG. 35 may be wrapped to close the end 52A of carton 52. Also, bottom flap 54B will be folded around and inserted back into opening 52A to close the package. The package may be opened by removing any wrapping. Thereafter flap 54B is pulled out, torn off, and discarded.

Next, the user may reach in through alcove 50B and press flap 54T up. Flap 54TB will rise above shoulder 64 to a position above tray 50, allowing outward travel. At the same time, the user will push protrusion 66B while grasping the forward end of the tray and pulling at outwardly to allow the travel shown in FIG. 36. This dual hand maneuver makes the package child resistant.

Tray 50 cannot be removed from carton 52 because flap 54T (FIG. 37) engages the distal edge of tether 66, thereby limiting outward travel to a predetermined amount. Likewise, flaps 54S engage the forward faces of shoulders 56, also preventing further outward movement.

With tray 50 fully deployed, the user may now grasp product P' through notches 50C, and use the product for its intended purpose. If product P' has not been expended, it may be returned to socket 58 and slipped under holder 66A. The user may now push tray 50 back to the retracted position. Eventually, shoulder 64 will pass flap 54T, so that the flap can spring back into engagement with the forward face of the shoulder, as shown in FIG. 35. Under those circumstances, tray 50 will not inadvertently slide out of carton 52 but will remain stored and protected in the retracted position.

Referring to FIGS. 38-41, components corresponding to those previously illustrated in FIGS. 1-9, have the same reference numbers but increased by 60 Tray 70 is a container that can receive on its rim a lid 71, and both may be thermoformed articles (e.g., vacuum formed, or blow or injection molded) The front of lid 71 has a finger tab 71C.

Sections 71A and 71B of lid 71 are joined by a transverse wrinkle 71D that acts as a hinge. Sections 71A and 71B each have a pan-like shape with short walls topped with flanges (except at the hinge 71D).

Tray 70 is designed to hold a loose product (e.g., tobacco). Tray 70 has a vertically disposed pair of aft shoulders 76 on the right and left. Shoulders 76 are stops that are also referred to as riders or abutments.

A well-like feature 82 in tray 70 has a distal step that forms an aft abutment 82A. Another well-like feature 80 in tray 70 has a distal step that forms a forward abutment 80A. (Abutments 82A and 80A are also referred to as a rider in the form of a shoulder acting as a stop.) It will be noticed that abutment 80A is longitudinally spaced from previously mentioned abutments 76 and 82A.

Figure 39:
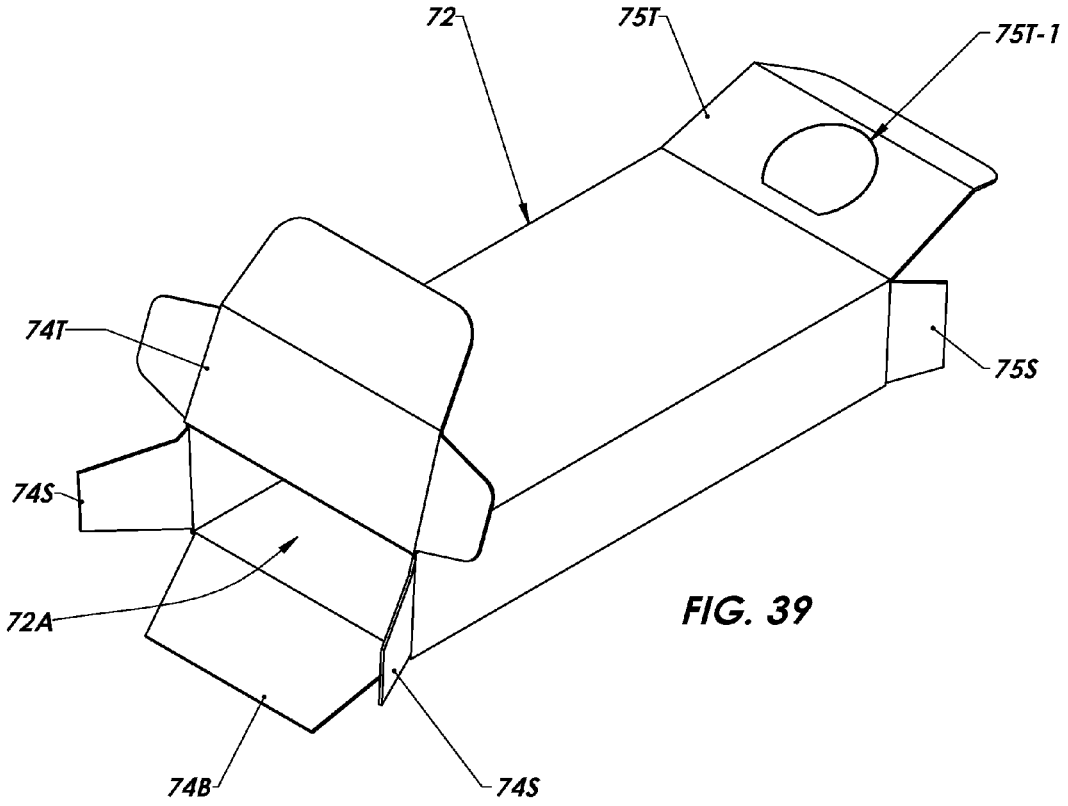
FIG. 39 is a perspective view of carton for holding the tray of FIG. 30A, shown with its two ends open.

In FIG. 39, carton 72 is shown as a rectangular box with a front opening 72A (access port) bordered by four flaps: two side flaps 74S, a top flap 74T, and bottom flap 74B. Each of the flaps 74S, 74T, and 74B are disposed 90° from the adjacent flap. Flaps 74S and 74B act as catches, while flap 74T will be folded down and used to close the open end 72A of carton 72. The back of carton 72 is closed by means of a pair of side flaps 75S (only one visible in FIG. 39) and a top flap 75T, which has a circular rear opening 751-1

Figure 40:
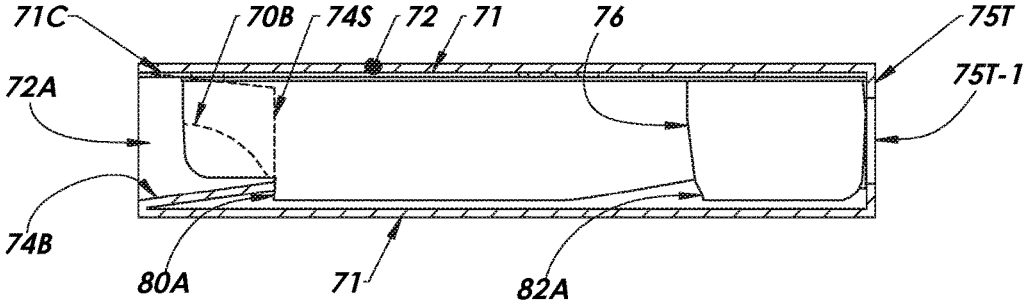
FIG. 40 is a elevational view of the tray of FIG. 38 installed in the carton of FIG. 39 with the carton sectioned for illustrative purposes.

Referring to FIG. 40, the illustrated package is composed of a carton 72 and sliding tray 70. Tray 70 is shown completely lodged inside carton 72, this condition being referred to as the retracted position of the tray.

The distal end of flap 74B is shown engaging abutment 80A to prevent outward movement of tray 70 from the retracted position. In this position the lower front corner of tray 70 does not extend through the opening 72A. This fact plus the existence of alcove 70B leaves almost all of flap 74B accessible. Accordingly, a user can manually depress flap 74B so it descends below abutment 80A to allow tray 70 to move outwardly from the retracted position. This can be accomplished by simultaneously pushing on the back of tray 70 through rear opening 75T-1. Also, the user can grasp tab 71C to fully pull tray 70 and lid 71 out. These dual hand maneuvers make the package child resistant.

Figure 41:
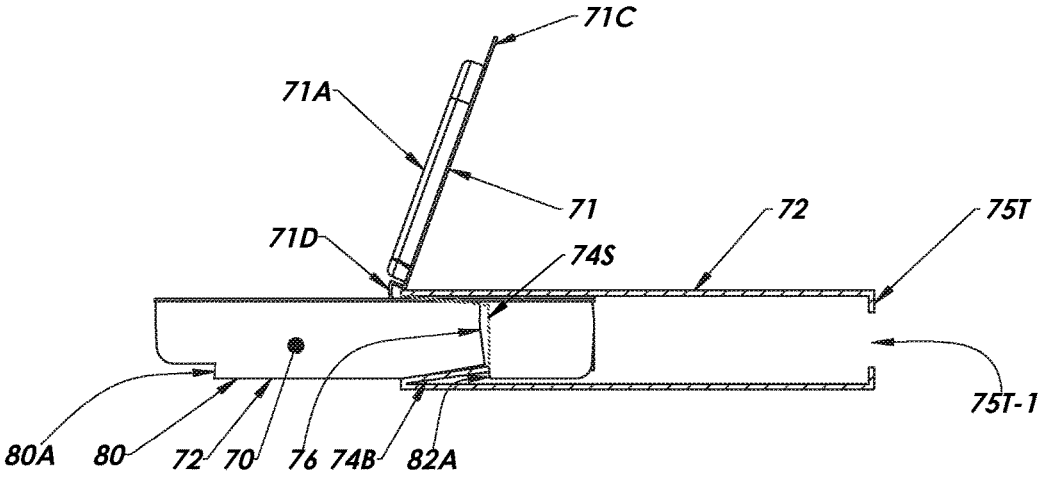
FIG. 41 is an elevational view of the package of FIG. 40 shown with the tray extended forward but restrained on a front catch, and with the front section of the lid swung upwardly.

In FIG. 41, tray 70 has moved outwardly from carton 72 to a fully extended position, exposing lid section 71A, which has been swung up about hinge 71D by lifting tab 71C.

In this fully extended position, flap 74B has swung inwardly to engage previously mentioned abutment 82A, which engagement prevents further outward movement of tray 70. Also, flaps 74S engage abutments 76, which engagement also prevents further outward movement of the tray. Neither of the side flaps 74S are directly visible in this view, but left side flab 74S is shown in phantom and extending to reach shoulder 76 on the left side of tray 50.

It will be noticed that flap 74B has a dual purpose. Specifically, flap 74B can engage abutment 82A to prevent removal of the tray 70, and also is able to engage abutment 80A (FIG. 240) to keep the tray in the retracted position.

In ordinary use, product is delivered to a user inside tray 70 with lid section 71A releasably closed on the tray, section 71B glued or snapped onto the tray, and the tray placed inside carton 72 as shown in FIG. 40. The package of FIG. 40 may be wrapped to prevent tampering.

When the package is unwrapped as shown in FIG. 40, the user may reach in and depress flap 74B, which will descend to a position below tray 70 allowing the passage of feature 80 and abutment 80A. At the same time, the user can push tray 70 is through opening 75T-1, while using tab 71C to pull tray 70 and lid 71 outwardly to the position shown in FIG. 41.

Tray 70 cannot be removed from carton 72 because flap 74B will engage the forward face of abutment 82A, thereby limiting outward travel to a predetermined amount. Likewise, flaps 74S engage the forward faces of abutments 76, also preventing further outward movement.

With lid section 71A open, the user may obtain any desired amount of product in tray 70, and use the product for its intended purpose. If the product has not been expended, the user may now close section 71A, and push tray 70 back to the retracted position. Eventually, feature 80 will pass over flap 74B, so that the flap can spring back into engagement with the forward face of abutment 80A, as shown in FIG. 40. Under those circumstances, tray 70 will not inadvertently slide out of carton 72 but will remain stored and protected in the retracted position.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A packaging method employing a tray slidably mounted in a carton that has a front access port bordered by one or more catches, the tray having a pair of riders, wherein said pair of riders successively engages said one or more catches in order to restrict outward movement of said tray, the method comprising the steps of:

inwardly moving said tray to a retracted position;

using a first one of said pair of riders and said one or more catches to hold said tray in said retracted position in response to inward movement of said tray to said retracted position;

manually operating at least one of said one or more catches to clear at least one of said pair of riders to increase outward mobility of said tray and allow said at least one of said pair of riders to move outwardly past said one or more catches, the step of operating said at least one of said one or more catches comprising the step of using said one or more catches and a first one of said pair of riders to release said tray from said retracted position;

manually extracting said tray from said retracted position with a manipulation distinct from, and simultaneously with, said step of manually operating said one or more catches; and on release of said tray from the retracted position, a second one of said pair of riders operating to limit outward travel of said tray from said retracted position to a predetermined amount.

2. A method according to claim 1 wherein said one or more catches comprise one or more flaps, the step of operating said one or more catches being performed by manually depressing said one or more flaps.

3. A method according to claim 1 wherein the step of operating said second one of said pair of riders is performed to prevent removal of said tray from said carton.

4. A method according to claim 1 wherein the steps of holding said tray in a retracted position, and clearing said at least one of said one or more catches are performed using a single one of said one or more catches, said single one being operable to successively hold said tray in said retracted position and limit outward travel of said tray from said retracted position to a predetermined amount.

5. A method according to claim 1 wherein said pair of riders are longitudinally spaced with the second one located rearwardly from the first one.

6. A method according to claim 1 wherein said tray comprises a forward cantilevered tab, the step of manually operating said one or more catches being performed by manually depressing said forward cantilevered tab in order to depress said at least one of the one or more catches.

7. A method according to claim 1 wherein said pair of riders comprise a forward abutment and an aft abutment, the steps of holding said tray in a retracted position, and limiting outward travel of said tray being performed by manually deflecting one of said one or more catches in order to clear said forward abutment and enable outward movement of said tray until said aft abutment engages one of said one or more catches.

8. A method according to claim 1 wherein said one or more catches comprises a first flap and a second flap each located at said front access port, said second flap being disposed 90° relative to said first flap, the step of holding said tray in a retracted position being performed by using said first flap and said first one of said pair of riders, the step of limiting outward travel of said tray being performed by using said second flap and said second one of said pair of riders.

9. A method according to claim 1 wherein one of said pair of riders comprises a pair of abutments located on opposite sides of said tray, the step of limiting outward travel of said tray being performed by using said pair of abutments and said one or more catches.

10. A method according to claim 1 wherein said pair of riders are longitudinally spaced, said one or more catches comprising a first and a second catch, said first and said second catch being operable to engage different respective ones of said pair of riders.

11. A method according to claim 10 wherein said first and said second catch are a pair of flaps each located at said front access port.

12. A method according to claim 1 wherein said tray has a socket and wherein a tether connects between said tray and a holder, the method comprising the steps of:

placing a product in said socket; and pushing said holder into said socket and over said product to hold said product in place.

13. A method according to claim 12 wherein said carton has a rear opening, and said tether has a protrusion, the method including the step of:

projecting the protrusion through said rear opening when said tray is in said retracted position; and pushing said protrusion inwardly to move said tray outwardly after manually operating at least one of said one or more catches.

14. A method according to claim 1 wherein said one or more catches includes a lower flap at said front access port, said tray having a lower recess in front, the step of operating at least one of said one or more catches being performed by reaching through said lower recess and depressing said lower flap.

15. A method according to claim 1 wherein said tray comprises a container having a rim, and a lid with a front and rear section that are hinged together, the method comprising the steps of:

fitting said lid in said rim of said container; and releasing said front section of said lid and swinging said front section up while said rear section remains in said rim.

16. A method according to claim 1 wherein the step of manually operating said at least one of said one or more catches is performed with a first hand at a first location, the method including the step of:

manually engaging said tray at a second location with a second hand in order to outwardly translate said tray, said second location being spaced from said first location to prevent said first hand from manually engaging said tray at said second location while simultaneously operating said at least one of said one or more catches at said first location.

* * * * *